US010494902B1

(12) United States Patent
Adam

(10) Patent No.: US 10,494,902 B1
(45) Date of Patent: Dec. 3, 2019

(54) DOWNHOLE TOOL WITH EXTERNALLY ADJUSTABLE INTERNAL FLOW AREA

(71) Applicant: TURBO DRILL INDUSTRIES, INC., Conroe, TX (US)

(72) Inventor: Mark Adam, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 16/155,657

(22) Filed: Oct. 9, 2018

(51) Int. Cl.
*E21B 41/00* (2006.01)
*E21B 34/06* (2006.01)

(52) U.S. Cl.
CPC ..... *E21B 41/00* (2013.01); *E21B 34/06* (2013.01); *E21B 41/0078* (2013.01)

(58) Field of Classification Search
CPC ..... E21B 34/14; E21B 34/06; E21B 41/0078; E21B 23/004; E21B 43/26; E21B 7/18
See application file for complete search history.

(56) References Cited

U.S. PATENT DOCUMENTS 2,327,051 A * 8/1943 Lyons ..... E21B 37/00 166/222
3,129,777 A * 4/1964 Haspert ..... E21B 10/61 175/340
3,220,496 A * 11/1965 Beck ..... E21B 10/24 138/42
4,355,685 A * 10/1982 Beck ..... E21B 23/006 166/240
4,429,747 A * 2/1984 Williamson, Jr. ..... E21B 34/14 166/321
4,450,914 A * 5/1984 Elphick ..... E21B 41/0078 166/222
4,625,799 A * 12/1986 McCormick ..... E21B 23/006 134/167 C
4,921,044 A * 5/1990 Cooksey ..... E21B 17/06 166/116
5,029,644 A * 7/1991 Szarka ..... E21B 23/00 166/223
5,355,956 A * 10/1994 Restarick ..... E21B 43/082 166/229
5,803,179 A * 9/1998 Echols ..... E21B 43/084 166/242.1
7,793,714 B2 * 9/2010 Johnson ..... E21B 34/063 166/205

(Continued)

FOREIGN PATENT DOCUMENTS

CA 2934369 A1 * 6/2015 ..... E21B 41/0078

OTHER PUBLICATIONS

International Search Report and Written Opinion issued in PCT/US18/55061 dated Dec. 21, 2018 (10 pages).

*Primary Examiner* — Jennifer H Gay
(74) *Attorney, Agent, or Firm* — Adolph Locklar

(57) ABSTRACT

A downhole tool includes an outer sub and a mandrel positioned within the outer sub. The outer sub and the mandrel are tubular. The interior of the mandrel defines a bore flow path, and the annular space between the outer sub and the mandrel defines an annular flow path. One or more nozzle ports are formed in the mandrel to fluidly couple the bore flow path and the annular flow path. A nozzle is positioned in each nozzle port. The nozzle includes a nozzle body having a flow path formed therein to fluidly couple the bore flow path to the annular flow path through the nozzle.

15 Claims, 20 Drawing Sheets

(56) References Cited

U.S. PATENT DOCUMENTS 7,832,481 B2 * 11/2010 Martindale ..... B24C 1/045 166/298
9,121,248 B2 * 9/2015 Hofman ..... E21B 34/08
9,416,626 B2 * 8/2016 Xu ..... E21B 27/005
2002/0005299 A1 1/2002 Estep et al.
2006/0118296 A1 * 6/2006 Dybevik ..... E21B 17/18 166/242.1
2007/0204995 A1 * 9/2007 Hofman ..... E21B 34/14 166/308.1
2009/0101349 A1 * 4/2009 Johnson ..... E21B 34/063 166/307
2009/0277650 A1 11/2009 Casciaro et al.
2010/0044025 A1 * 2/2010 Martindale ..... B24C 1/045 166/55
2010/0187016 A1 * 7/2010 Marshall ..... E21B 4/14 175/293
2010/0276927 A1 * 11/2010 Simonian ..... E21B 17/042 285/383
2011/0192650 A1 * 8/2011 Swadi ..... C22C 1/05 175/296
2011/0203809 A1 8/2011 Knobloch, Jr. et al.
2012/0090847 A1 * 4/2012 Getzlaf ..... E21B 23/02 166/305.1
2012/0181043 A1 7/2012 Patel
2013/0008647 A1 1/2013 Dirksen et al.
2013/0180721 A1 * 7/2013 Getzlaf ..... E21B 34/06 166/308.1
2013/0180724 A1 * 7/2013 Nguyen ..... E21B 43/12 166/316
2014/0014360 A1 * 1/2014 Wilson ..... E21B 21/103 166/373
2014/0251636 A1 * 9/2014 Hofman ..... E21B 34/063 166/373
2014/0262211 A1 * 9/2014 Xu ..... E21B 23/006 166/179
2014/0374111 A1 * 12/2014 Xu ..... E21B 27/005 166/311
2015/0129205 A1 * 5/2015 Hofman ..... E21B 34/063 166/250.01
2015/0226048 A1 * 8/2015 Thurman ..... E21B 43/32 166/303
2015/0233218 A1 * 8/2015 Myhre ..... E21B 29/06 166/281
2015/0267514 A1 * 9/2015 Dotson ..... E21B 41/0078 166/297
2016/0130908 A1 * 5/2016 Nguyen ..... E21B 43/086 166/205
2016/0298406 A1 10/2016 Greening et al.
2016/0326843 A1 * 11/2016 Harmat ..... E21B 41/0078
2016/0333664 A1 11/2016 Ismail et al.
2017/0159419 A1 * 6/2017 Tolman ..... E21B 43/263
2017/0254176 A1 * 9/2017 van Petegem ..... E21B 34/063
2018/0252078 A1 * 9/2018 Schultz ..... E21B 34/063
2018/0306000 A1 * 10/2018 Deboer ..... E21B 21/103
2018/0363453 A1 * 12/2018 Canning ..... E21B 47/1015

* cited by examiner

DOWNHOLE TOOL WITH EXTERNALLY ADJUSTABLE INTERNAL FLOW AREA

TECHNICAL FIELD/FIELD OF THE DISCLOSURE

The present disclosure relates to downhole tools, and specifically to fluid actuated downhole tools.

BACKGROUND OF THE DISCLOSURE

Some downhole drilling tools contain an outer housing with a mandrel positioned therein. In such a tool, the mandrel may be tubular and may define a mandrel bore. The mandrel bore may define a bore fluid path allowing fluid flow from drilling pumps to pass through downhole drilling tool. The annular area formed between the outer surface of the mandrel and the inner surface of the outer housing may define an annular fluid path. Some downhole tools may contain both a bore fluid path and an annular fluid path. It may be desirable to control or limit fluid flow from the bore fluid path to the annular fluid path or vice versa. One method of achieving this is to install nozzles in a barrier portion between the bore fluid path and the annular fluid path, such that the desired total flow area (TFA) between bore fluid path and annular fluid path may be configured during downhole tool assembly. In a traditional tool, the nozzles may be positioned for access should the downhole tool set-up change, such as to require a different TFA, a tubular connection between the outer sub and another tubular of the tool string may be broken out allowing access such that the nozzles may be removed and replaced. It may even be possible to change a TFA configuration whilst downhole tool is located on the rig floor, however, breaking a threaded connection between tubular members to change the nozzle TFA on the rig floor is time consuming and requires the use of large equipment.

SUMMARY

The present disclosure provides for a downhole tool. The downhole tool may include an outer sub, the outer sub being tubular. The downhole tool may include a mandrel. The mandrel may be tubular and may be positioned within the outer sub. The interior of the mandrel may define a bore flow path. The annular space between the mandrel and the outer sub may define at least part of an annular flow path. The mandrel may include at least one nozzle port formed in the mandrel fluidly coupling the bore flow path to the annular flow path. The downhole tool may include a nozzle mechanically coupled to the nozzle port of the mandrel. The nozzle may include a nozzle body having a flow path formed therein to fluidly couple the bore flow path to the annular flow path through the nozzle.

The present disclosure also provides for a downhole apparatus. The downhole apparatus may include a downhole tool. The downhole tool may include an outer sub, the outer sub being tubular. The downhole tool may include a mandrel. The mandrel may be tubular and may be positioned within the outer sub. The interior of the mandrel may define a bore flow path. The annular space between the mandrel and the outer sub may define at least part of an annular flow path. The mandrel may include at least one nozzle port formed in the mandrel fluidly coupling the bore flow path to the annular flow path. The downhole tool may include a nozzle mechanically coupled to the nozzle port of the mandrel. The nozzle may include a nozzle body having a flow path formed therein to fluidly couple the bore flow path to the annular flow path through the nozzle. The downhole apparatus may include a downhole tool control apparatus adapted to selectively open or close an unrestricted flow path from the bore flow path to the annular flow path.

The present disclosure also provides for a method for adjusting the total flow area between a bore fluid path and an annular flow path of a downhole tool. The method may include providing the downhole tool. The downhole tool may include an outer sub, the outer sub being tubular. The outer sub may have an outer sub port formed therein. The outer sub port may extend through the wall of the outer sub. The downhole tool may include an outer plug mechanically coupled to the outer sub port. The outer plug may be removeable and may fluidly seal the outer sub port. The downhole tool may include a mandrel being tubular and positioned within the outer sub. The interior of the mandrel may define a bore flow path. The annular space between the mandrel and the outer sub may define at least part of the annular flow path. The mandrel may have at least one nozzle port formed in the mandrel fluidly coupling the bore flow path to the annular flow path. The nozzle port may be aligned with the outer sub port. The downhole tool may include a nozzle mechanically coupled to the nozzle port of the mandrel. The nozzle may include a nozzle body having a flow path formed therein to fluidly couple the bore flow path to the annular flow path through the nozzle. The method may further include removing the outer sub plug from the outer sub port, removing the nozzle from the nozzle port of the mandrel through the outer sub port, selecting a second nozzle having a nozzle flow path of a different flow area than the first nozzle, installing the second nozzle to the nozzle port of the mandrel through the outer sub port, and installing the outer sub plug to the outer sub port

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
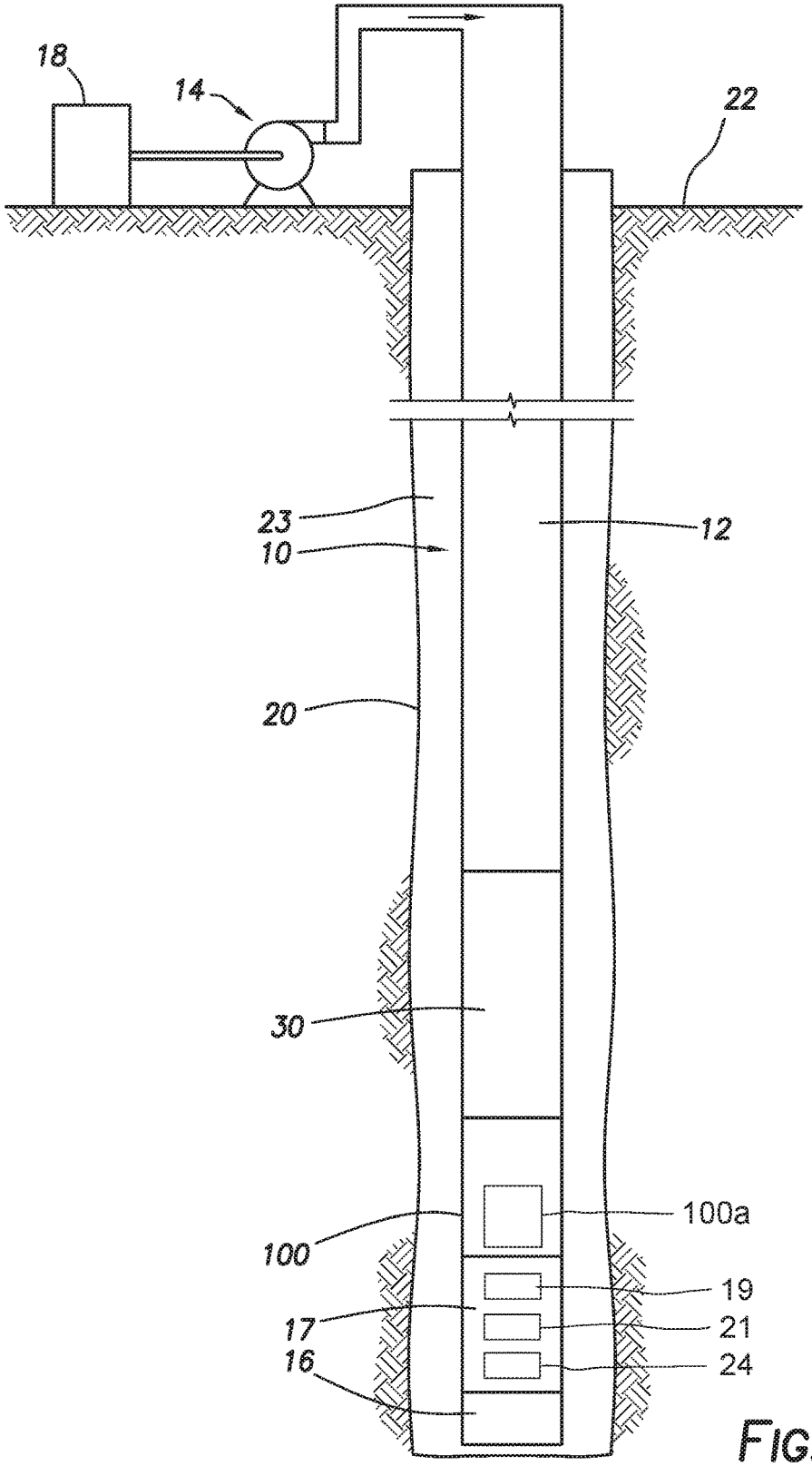
FIG. 1 depicts a schematic view of a wellbore having a downhole tool positioned therein consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drill string 10 positioned within wellbore 20. Drill string 10 may include downhole tool 100. Drill string 10 may be constructed from a plurality of tubular components that together define drill string bore 12. Wellbore annulus 23 may be defined as the annular space within wellbore 20 about drill string 10. One or more pumps 14 may be positioned to pump fluid through drill string bore 12. In some embodiments, one or more pumps 14 may be adapted to provide fluid flow through drill string bore 12. Pumps 14 may be controlled by controller 18 so as to provide different flow rates of fluid through drill string bore 12. For the purposes of this disclosure, "up", "above", and "upper" denote a direction within wellbore 20 toward the surface 22, and "down", "below", and "lower" denote a direction within wellbore 20 away from the surface 22.

FIG. 1 further depicts downhole tool 100. For the purposes of this disclosure, downhole tool 100 may be any tool, collar, or other component of drill string 10 that includes a bore flow path and an annular flow path as further described below. In some embodiments, downhole tool 100 may be a fluid-actuated or flow-controlled tool 100*a* configured such that flow within the bore flow path and annular flow path may modify or control the operation of downhole tool 100. Non-limiting examples of downhole tool 100 may be a reamer, underreamer, packer, downhole motor, stabilizer, centralizer, pulse tool, vibration tool, jarring tool, or any other downhole tool.

Although depicted at a lower end of drill string 10, downhole tool 100 may be positioned at any point along drill string 10. Downhole tool 100 may be positioned within drill string 10 proximate to downhole tool control apparatus 30 and may be operatively coupled to downhole tool control apparatus 30. In some embodiments, downhole tool 100 may be a fluid-actuated device to which downhole tool control apparatus 30 controls the flow of fluid. In some embodiments, downhole tool control apparatus 30 may be used to change one or more operational states or parameters of downhole tool 100 by modifying the fluid flow through the bore flow path and annular flow path of downhole tool 100. In some embodiments, downhole tool control apparatus 30 may be a drop-ball seat or may include an actuator or indexer as further described herein below. In some embodiments, for example and without limitation, downhole tool control apparatus 30 may cause downhole tool 100 to change between operating modes, such as from a first operating mode to a second operating mode. Downhole tool 100 may initially be in the first operating mode and then be selectively changed to the second operating mode by the operation of downhole tool control apparatus 30. In some embodiments as discussed herein, the first operating mode and second operating mode may, for example, correspond to an activation or deactivation of downhole tool 100. In some embodiments, the first operating mode and second operating mode may correspond to different positions of downhole tool 100. In other embodiments, downhole tool control apparatus 30 may be omitted such that fluid flow through the bore flow path and the annular flow path are not selectively regulated during use, i.e. such that the amount of fluid flow through the bore flow path and the annular flow path is controlled only by the characteristics of the fluid, flow rate of the fluid, and geometry of downhole tool 100 as further described herein below.

In some embodiments, drill string 10 may include one or more additional tools below downhole tool 100 including, for example and without limitation bottom hole assembly (BHA) 17. As understood in the art, BHA 17 may include any tools for use in a wellbore. In some embodiments, BHA 17 may include, for example and without limitation, one or more of drill bit 16, MWD system 19, downhole motor 21, rotary steerable system 24, or other downhole tools. In some embodiments, downhole tool control apparatus 30, downhole tool 100, or both may be considered part of BHA 17 or positioned within BHA 17. In some embodiments, downhole tool control apparatus 30, downhole tool 100, or both may be considered positioned within drill string 10 substantially above the BHA 17.

Figure 2:
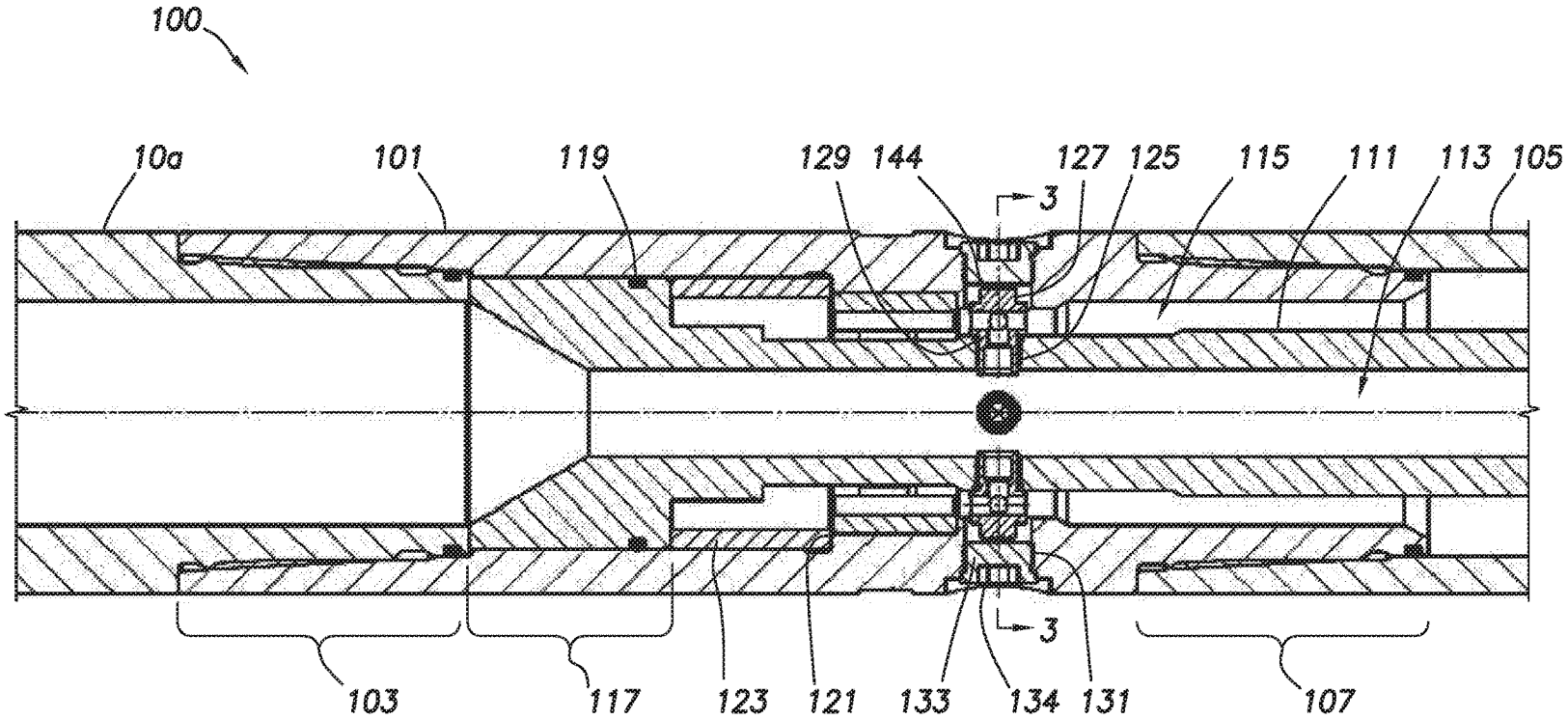
FIG. 2 depicts a cross section view of a downhole tool consistent with at least one embodiment of the present disclosure.

In some embodiments, as depicted in FIG. 2, downhole tool 100 may include outer sub 101. Outer sub 101 may be tubular and may be used to couple downhole tool 100 to the rest of drill string 10 above downhole tool 100, depicted as tubular 10*a*, by, for example and without limitation, upper coupler 103. In some embodiments, outer sub 101 may mechanically couple to outer housing 105 of downhole tool 100 by, for example and without limitation, lower coupler 107 located at the lower end of outer sub 101 and may be used to couple to drill string 10 below downhole tool 100 or other tubular components of downhole tool 100. Outer housing 105 may be tubular and may be used to, for example and without limitation, support other components of downhole tool 100. Upper coupler 103 and lower coupler 107 may be, for example and without limitation, threaded couplers as typically used to mechanically couple the tubular members of drill string 10.

In some embodiments, downhole tool 100 may include mandrel 111. Mandrel 111 may be tubular and may be positioned within outer sub 101 and outer housing 105 of downhole tool 100. The interior of mandrel 111 may define bore flow path 113 of downhole tool 100. Bore flow path 113 connects to drill string bore 12. In some embodiments, annular flow path 115 may be defined between the exterior of mandrel 111 and the interior of outer sub 101 and outer housing 105 of downhole tool 100. In some embodiments, mandrel 111 may include flange 117 positioned at the upper end of mandrel 111. In some embodiments, flange 117 may be of a larger diameter than the rest of mandrel 111 such that flange 117 abuts the inner surface of outer sub 101. In some embodiments, one or more seals 119 may be positioned between flange 117 and outer sub 101 to, for example and without limitation, fluidly isolate drill string bore 12 and bore flow path 113 from annular flow path 115 at the interface between flange 117 and outer sub 101.

In some embodiments, outer sub 101 may include mandrel hanger 121. Mandrel hanger 121 may be a lip or ridge formed on the inner surface of outer sub 101 such that flange 117 of mandrel 111 may rest on mandrel hanger 121 when mandrel 111 is positioned within outer sub 101. In some embodiments, tubular member 10*a* may, when positioned within upper coupler 103, abut mandrel 111 such that tubular member 10*a* may at least partially retain mandrel 111 against mandrel hanger 121. In some embodiments, spacer 123 may be positioned between mandrel hanger 121 and flange 117 such that mandrel 111 is retained against mandrel hanger 121 when tubular member 10*a* is fully engaged to outer sub 101. Spacer 123 may be a tubular member having a known length adapted to fit within upper coupler 103 to headspace the connection between mandrel hanger 121 and flange 117.

In some embodiments, one or more nozzle ports 125 may be formed in mandrel 111. Nozzle ports 125 may provide fluid connection between bore flow path 113 and annular flow path 115 such that fluid provided to downhole tool 100 through drill string bore 12 may flow through both bore flow path 113 and annular flow path 115 as described further below. In some embodiments, nozzle ports 125 may be formed as apertures through the wall of mandrel 111. Nozzle ports 125 may be formed orthogonally to the outer surface of mandrel 111 or may be formed at a non-orthogonal angle thereto. In some embodiments, each nozzle port 125 may be adapted to receive a nozzle 127. Nozzles 127 may mechanically couple to a respective nozzle port 125 by, for example and without limitation, a threaded connection. Nozzles 127 may, as discussed further herein below, be used to control the cross-sectional flow area of each nozzle port 125 and therefore may control the effective total flow area (TFA) of annular flow path 115, i.e. the cross-sectional flow area available to fluid flowing through annular flow path 115, for fluid flow from bore flow path 113 to annular flow path 115. In some embodiments, TFA may, for example and without limitation, determine a percentage flow split between bore flow path 113 and annular flow path 115, which may alter or define a desired pressure differential between bore flow path 113 and annular flow path 115. In some embodiments, one or more nozzle seals 129 may be positioned between nozzles 127 and mandrel 111 to fluidly seal the interface between nozzles 127 and mandrel 111.

Figure 3:
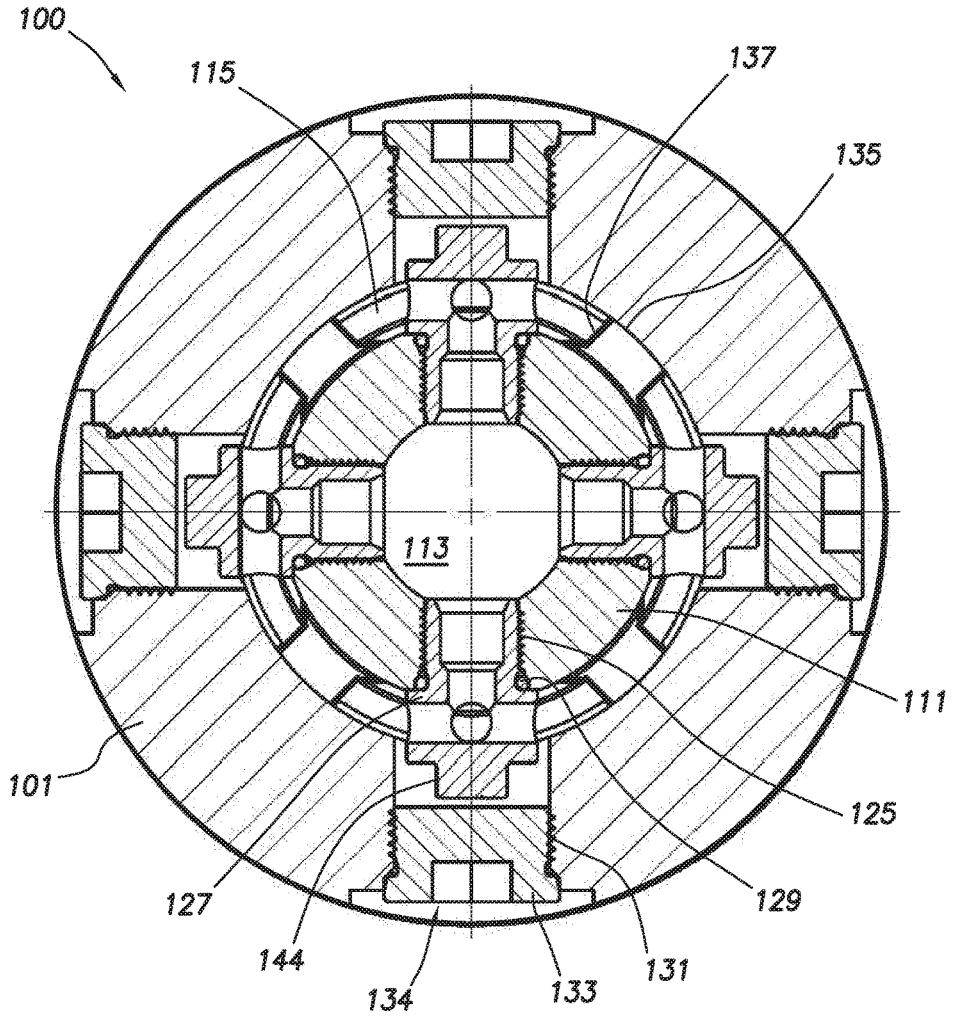
FIG. 3 depicts a cross section view of the downhole tool of FIG. 2 taken at line 3-3.
Figure 4A:
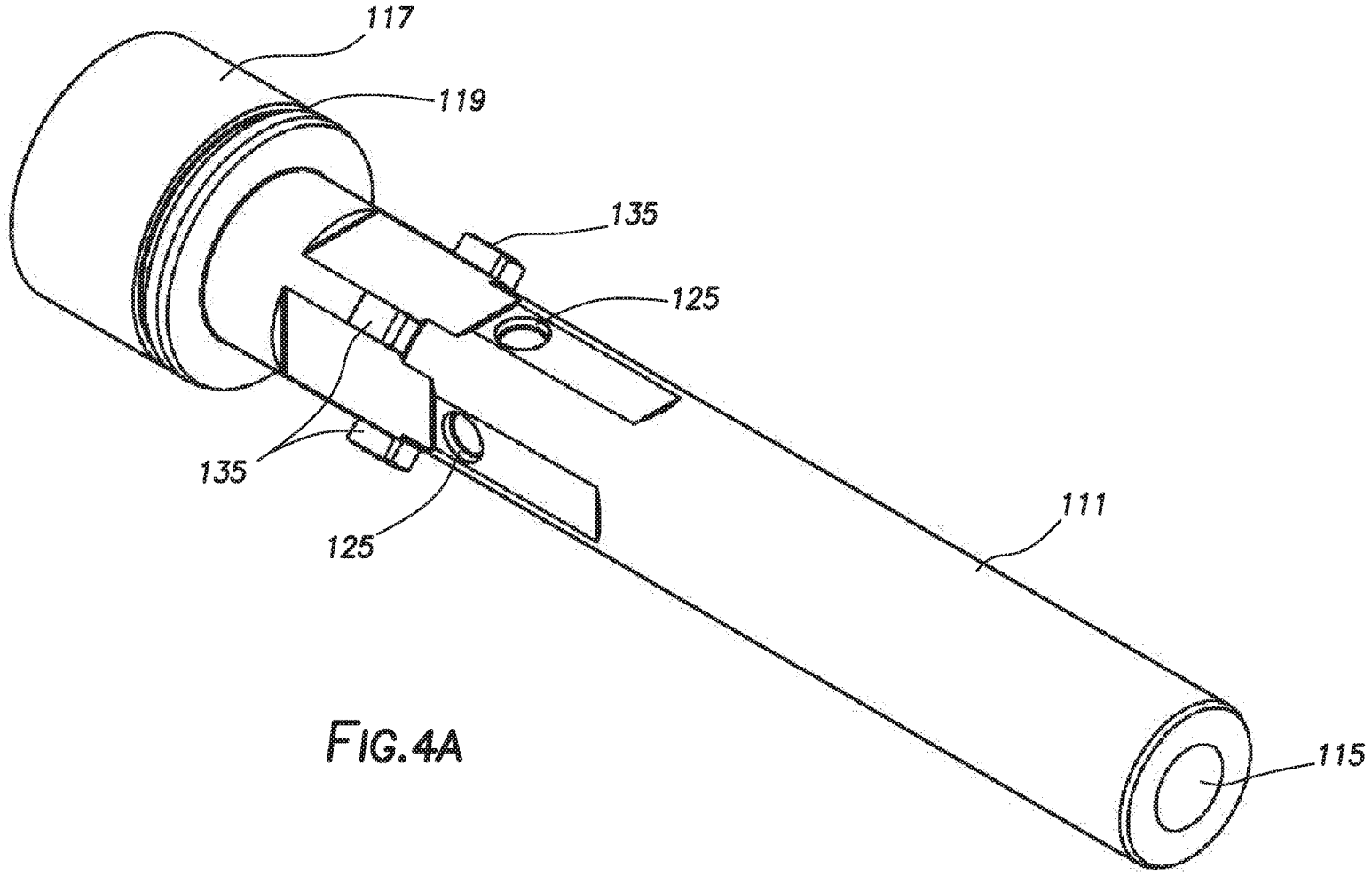
FIG. 4A depicts a perspective view of a mandrel of a downhole tool consistent with at least one embodiment of the present disclosure.
Figure 4C:
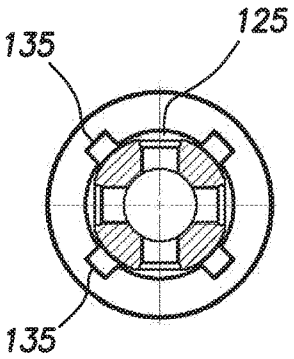
FIG. 4C depicts a cross section view of the mandrel of FIG. 4A taken at line 4C-4C.
Figure 4B:
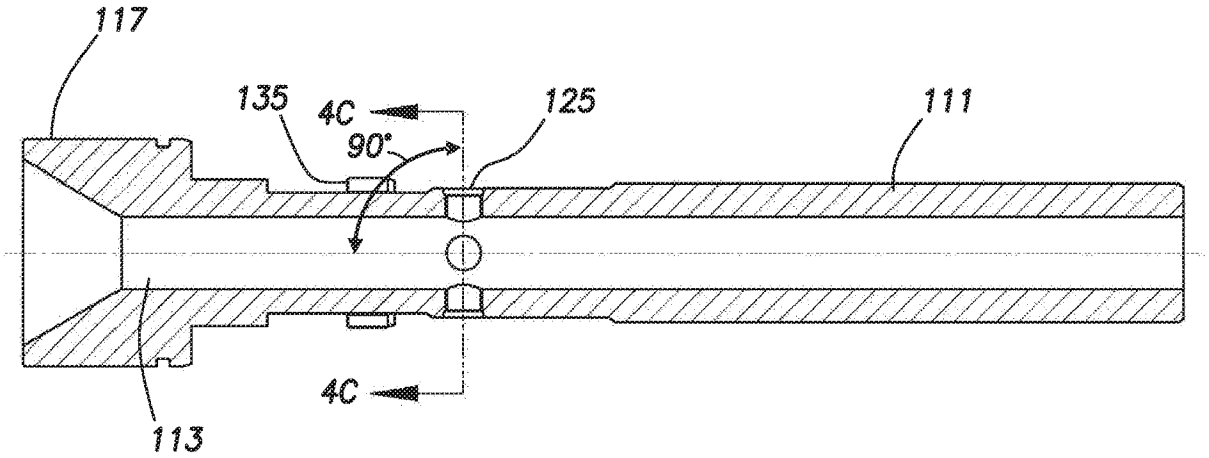
FIG. 4B depicts a cross section view of the mandrel of FIG. 4A.
Figure 5A:
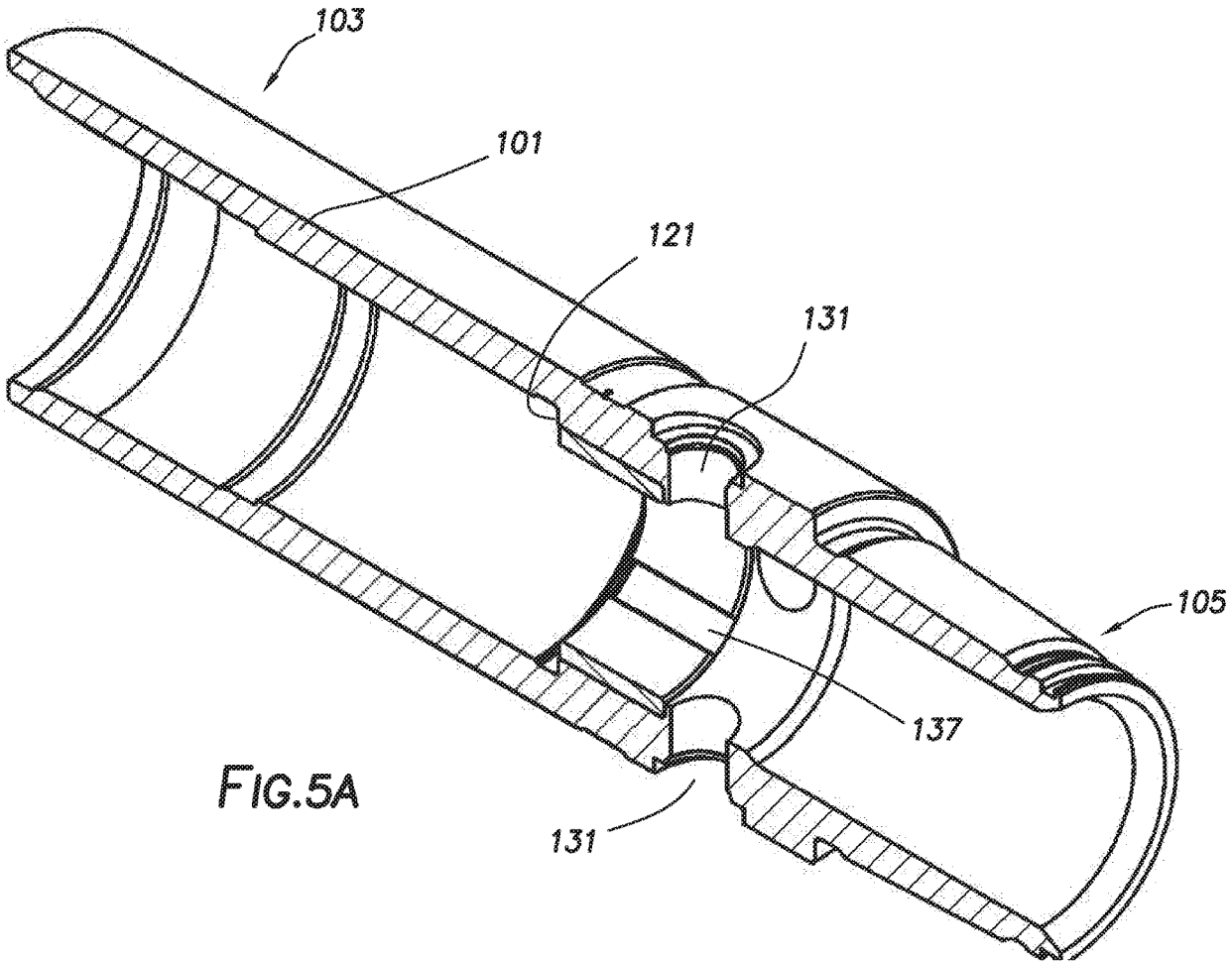
FIG. 5A depicts a perspective cross section view of an outer sub of a downhole tool consistent with at least one embodiment of the present disclosure.
Figure 5B:
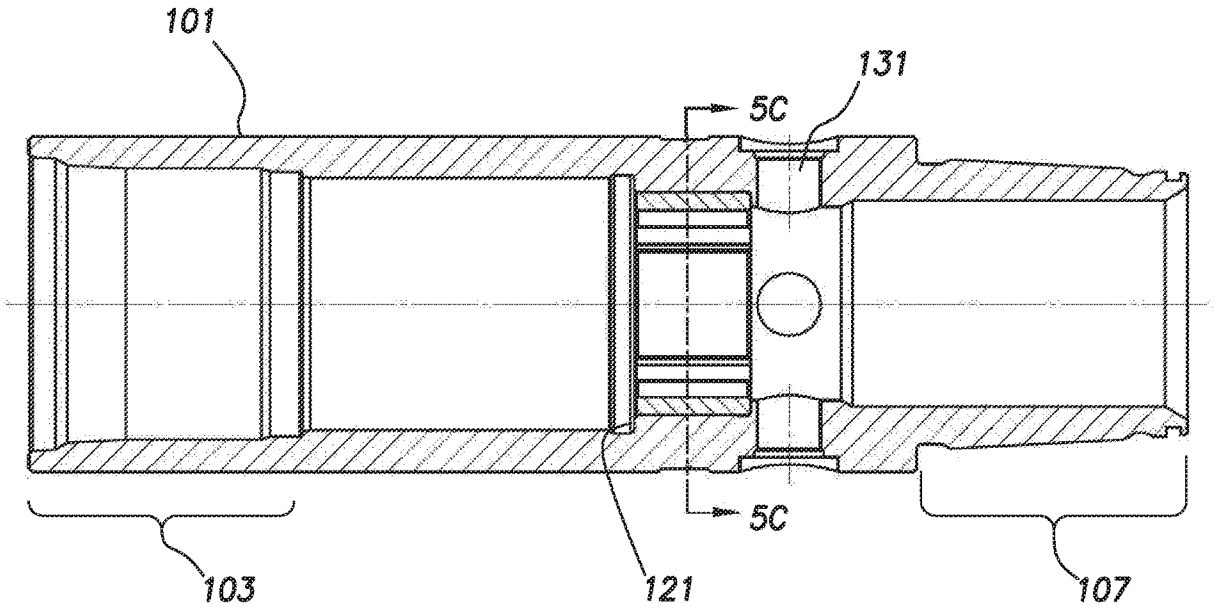
FIG. 5B depicts a cross section view of the outer sub of FIG. 5A.
Figure 5C:
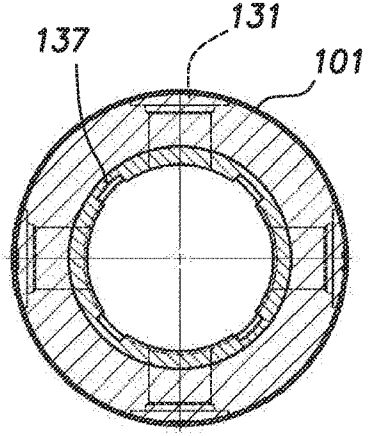
FIG. 5C depicts a cross section view of the outer sub of FIG. 5A taken at line 5C-5C.

In some embodiments, outer sub 101 may include one or more outer sub ports 131 such that each nozzle port 125 has a corresponding outer sub port 131 aligned therewith when mandrel 111 is installed into outer sub 101 as depicted in FIGS. 2, 3. In some embodiments, outer sub ports 131 may be adapted to receive outer plug 133. Outer plug 133 may be a generally cylindrical, solid body adapted to couple to outer sub ports 131. Each outer plug 133 may mechanically couple to a respective outer sub port 131 by, for example and without limitation, a threaded connection. In some such embodiments, outer plug 133 may include plug drive adapter 134 positioned on the outer surface of outer plug 133. Plug drive adapter 134 may include one or more features adapted to allow nozzle outer plug 133 to be installed or removed from outer sub 101. For example and without limitation, plug drive adapter 134 may include one or more bosses or recesses adapted to operatively connect to a tool to allow outer plug 133 to be rotated relative to outer sub 101 such as, for example and without limitation, one or more slots, polygonal bosses, or shaped recesses (such as hexagonal recesses depicted in FIGS. 2, 3) adapted to couple to a corresponding tool. Outer plugs 133 may, for example and without limitation, fluidly seal annular flow path 115 from wellbore annulus 23. In some embodiments, as discussed further below, outer plugs 133 may be removed from outer sub 101 to allow access to nozzles 127 through outer sub ports 131 without otherwise disassembling downhole tool 100.

In some embodiments, as depicted in FIGS. 3 and 4A-C, mandrel 111 may include one or more alignment splines 135. Each alignment spline 135 may be a radial extension from the outer surface of mandrel 111. In some embodiments, as depicted in FIGS. 3 and 5A-C, outer sub 101 may include one or more alignment slots 137 corresponding with alignment splines 135 of mandrel 111. When assembled, as depicted in FIG. 3, alignment splines 135 may fit within alignment slots 137 of outer sub 101 such that nozzle ports 125 and outer sub ports 131 remain in alignment when mandrel 111 is assembled to outer sub 101.

Figure 6:
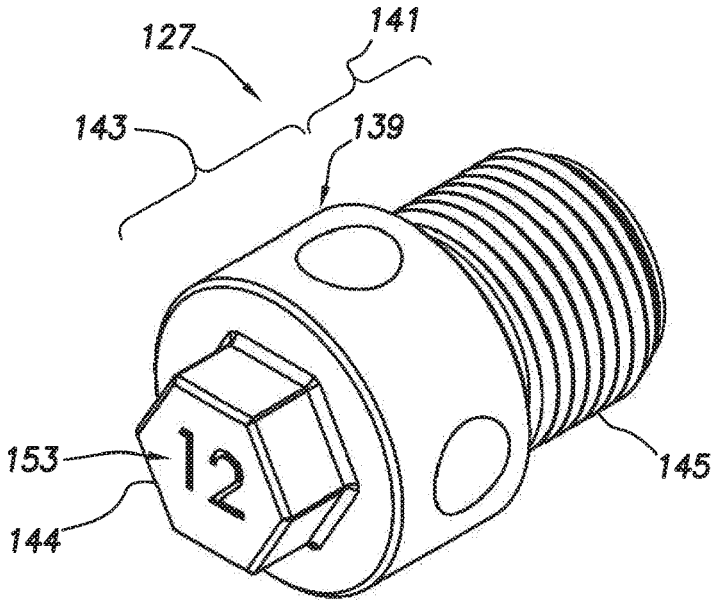
FIG. 6 depicts a perspective view of a nozzle consistent with at least one embodiment of the present disclosure.

FIGS. 6 and 6A-6C depict nozzle 127. Nozzle 127 may include nozzle body 139. Nozzle body 139 may include nozzle shank 141 and nozzle head 143. In some embodiments, nozzle shank 141 may include nozzle coupler 145 adapted to couple to nozzle ports 125 of mandrel 111. Nozzle coupler 145 may, in some embodiments, be an external thread adapted to engage a corresponding internal thread of nozzle ports 125. In some such embodiments, nozzle body 139 may include nozzle drive adapter 144 positioned on nozzle head 143 opposite nozzle shank 141. Nozzle drive adapter 144 may include one or more features adapted to allow nozzle 127 to be installed or removed from mandrel 111 by the application of torque from a tool such as a wrench. For example and without limitation, nozzle drive adapter 144 may include one or more bosses or recesses adapted to operatively connect to a tool to allow nozzle 127 to be rotated relative to mandrel 111 such as, for example and without limitation, one or more slots, polygonal bosses (such as a square or hexagonal head as depicted in FIG. 6), or shaped recesses adapted to couple to a corresponding tool. Nozzle head 143 may have a larger diameter than nozzle shank 141 such that underside 147 of nozzle head 143 proximate nozzle shank 141 may abut mandrel 111 when nozzle 127 is fully installed to mandrel 111.

In some embodiments, as discussed herein above, one or more nozzle seals 129 may be positioned between underside 147 of nozzle head 143 and mandrel 111 when nozzle 127 is fully installed to mandrel 111. When installed to mandrel 111, as depicted in FIG. 3, nozzle head 143 is positioned within annular flow path 115 and end 141*a* of nozzle shank 141 is exposed to bore flow path 113.

Figure 6A:
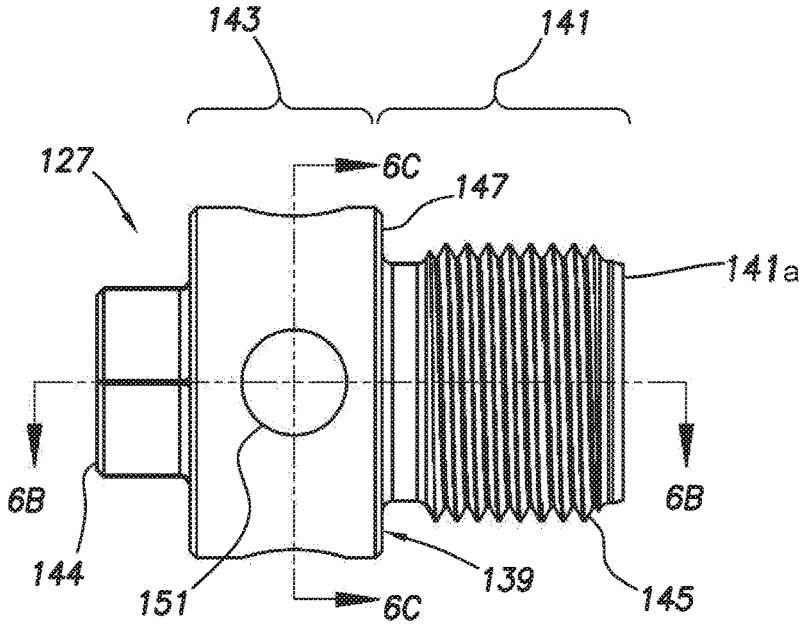
FIG. 6A depicts a side elevation view of the nozzle of FIG. 6.
Figure 6B:
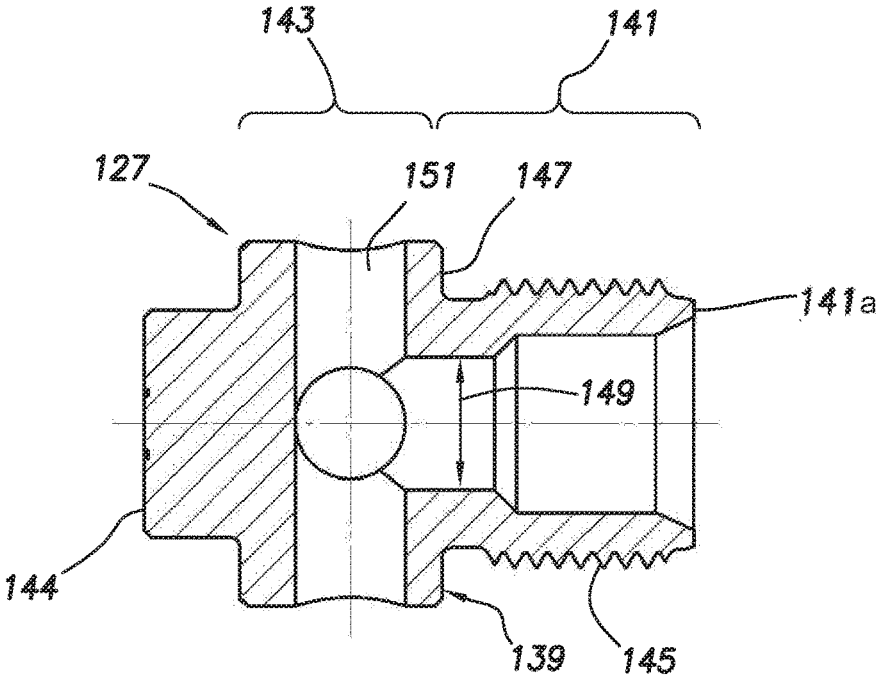
FIG. 6B depicts a cross section view of the nozzle of FIG. 6A taken at line 6B-6B.
Figure 6C:
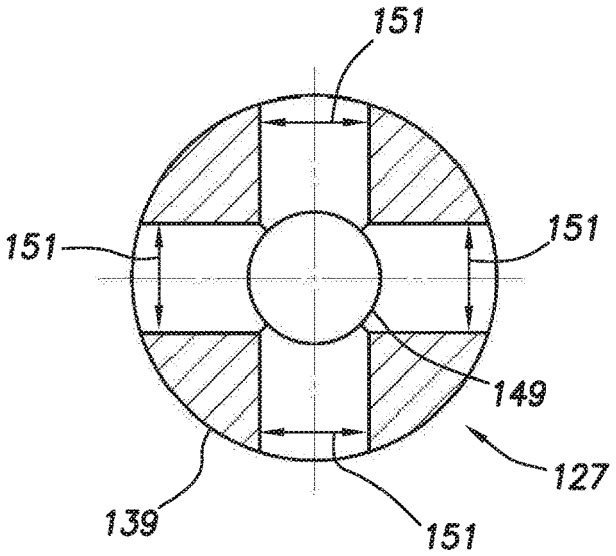
FIG. 6C depicts a cross section view of the nozzle of FIG. 6A taken at line 6C-6C.
Figure 7:
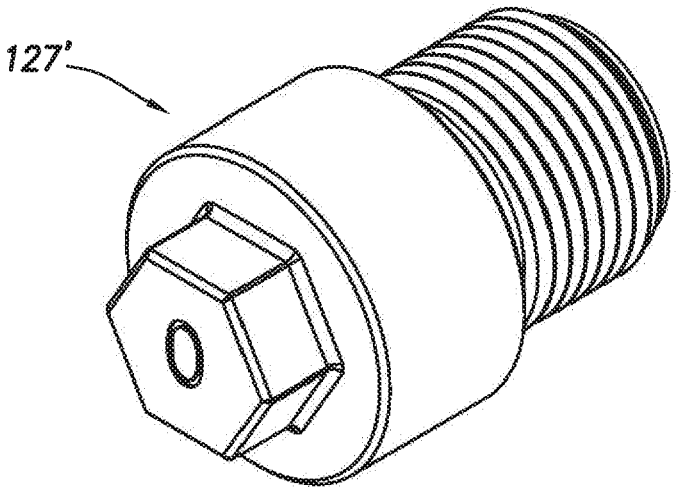
FIG. 7 depicts a perspective view of a blank nozzle consistent with at least one embodiment of the present disclosure.
Figure 7A:
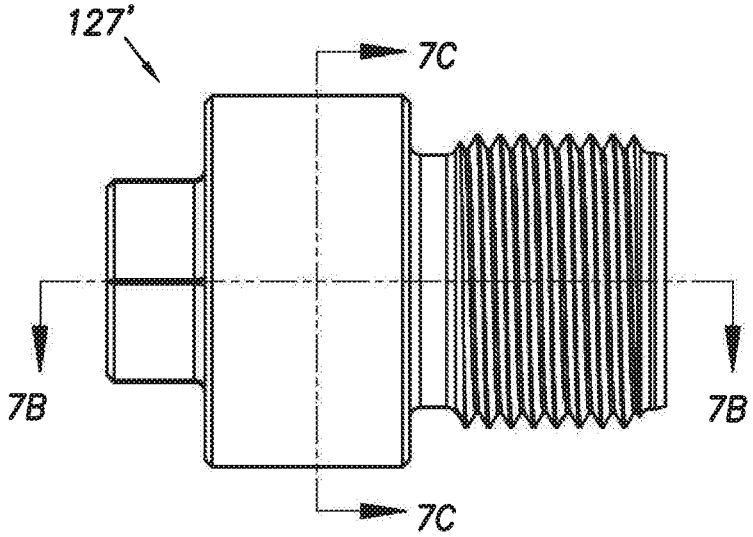
FIG. 7A depicts a side elevation view of the nozzle of FIG. 7.
Figure 7B:
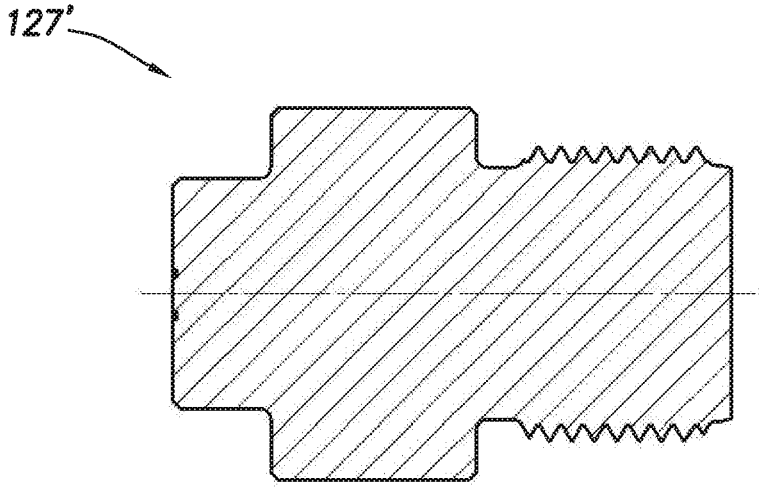
FIG. 7B depicts a cross section view of the nozzle of FIG. 7A taken at line 7B-7B.
Figure 7C:
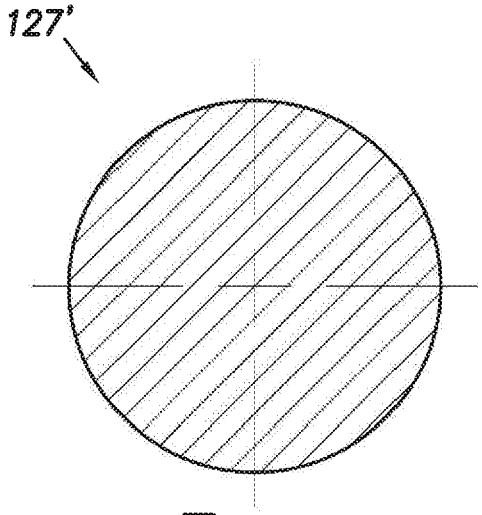
FIG. 7C depicts a cross section view of the nozzle of FIG. 7A taken at line 7C-7C.

In some embodiments, nozzle 127 may include one or more flow paths formed therein to allow fluid to flow from bore flow path 113 to annular flow path 115 when downhole tool 100 is in operation. For example, in some embodiments, nozzle shank 141 may include nozzle entry port 149 formed longitudinally therethrough. In some embodiments, nozzle head 143 may include one or more nozzle exit ports 151 formed therein. In some embodiments, nozzle exit ports 151 may extend longitudinally, radially, or a combination thereof through nozzle head 143. Nozzle exit ports 151 may intersect and be fluidly coupled to nozzle entry port 149 such that fluid may flow from bore flow path 113 to annular flow path 115 via nozzle entry port 149 and nozzle exit ports 151. Nozzle exit ports 151 may be formed in any pattern in nozzle head 143. For example and without limitation, in some embodiments, as depicted in FIGS. 6A-6C, two nozzle exit ports 151 may be formed in a cruciform pattern radially through nozzle head 143. In some embodiments, where nozzle exit ports 151 are formed radially through nozzle head 143 and where multiple nozzle exit ports 151 are used, fluid exiting nozzle 127 may be directed radially to, for example and without limitation, reduce risk of erosion or other damage to components of downhole tool 100 when compared with a longitudinal nozzle exit port 151.

In some embodiments, nozzle 127 may be formed such that the cross-sectional flow area through nozzle 127 is known. For example, in some embodiments, nozzle entry port 149 may be formed at least partially at a desired diameter such that the cross-sectional area, depicted as Ao, available to fluid flow through nozzle 127 is known. In some embodiments, nozzle exit ports 151 may be formed such that the total flow area through nozzle exit ports 151 is larger than Ao, thereby reducing the speed of fluid as it exits through nozzle exit ports 151 into annular flow path 115.

In some embodiments, nozzles 127 having various total flow areas may be manufactured and provided to an operator of downhole tool 100. In some such embodiments, each nozzle 127 may include a marking, such as headstamp 153 as depicted in FIG. 6, to indicate the total flow area of the nozzle 127. In some embodiments, for example and without limitation, by selecting nozzles 127 to be used with downhole tool 100 according to the total flow area of each, the effective total flow area between bore flow path 113 and annular flow path 115 may be selected. In some embodiments, nozzles 127 may be provided having multiple flow areas separated by known increments. For example and without limitation, nozzle flow areas may be provided and manufactured in 1/32" increments. In some such embodiments, headstamps 153 may indicate the flow area of the respective nozzle 127 such that the nozzle depicted in FIG. 6 would have a nozzle entry port 149 of a diameter of 12/32", resulting in a flow area of approximately 0.110 $in^2$. In some embodiments, by combining nozzles 127 of different flow areas, the total flow area between bore flow path 113 and annular flow path 115 may be specifically set.

In some embodiments, where flow through one or more particular nozzle ports 125 is not desired, such as to close off annular flow path 115 completely or to otherwise modulate the total flow area between bore flow path 113 and annular flow path 115, blank nozzle 127' as depicted in FIGS. 7 and 7A-C, may be utilized. Blank nozzle 127' may be formed exactly like nozzle 127 described above, however no flow path is formed therethrough. The flow area of blank nozzle 127' may therefore be described as 0, and flow through nozzle port 125 into which blank nozzle 127' is installed is zero.

In some circumstances, the desired total flow area of annular flow path 115 may need to be modified from the original configuration. Such a modification may be necessitated by changing downhole conditions, parameters of the fluid flowing through downhole tool 100, observed issues with the operation of downhole tool 100, or to change one or more aspects of the functionality of downhole tool 100. In such a circumstance, the total flow area of annular flow path 115 may be modified by the replacement of one or more nozzles 127 of downhole tool. In some embodiments, the replacement of nozzles 127 may be accomplished without the need to break out any tubular connections of drill string 10.

An operation to replace a nozzle 127 in a downhole tool will now be described with respect to FIGS. 8A-8E. For clarity, the particular operation described is to replace nozzle 127 with a blank nozzle 127'.

Figure 8A:
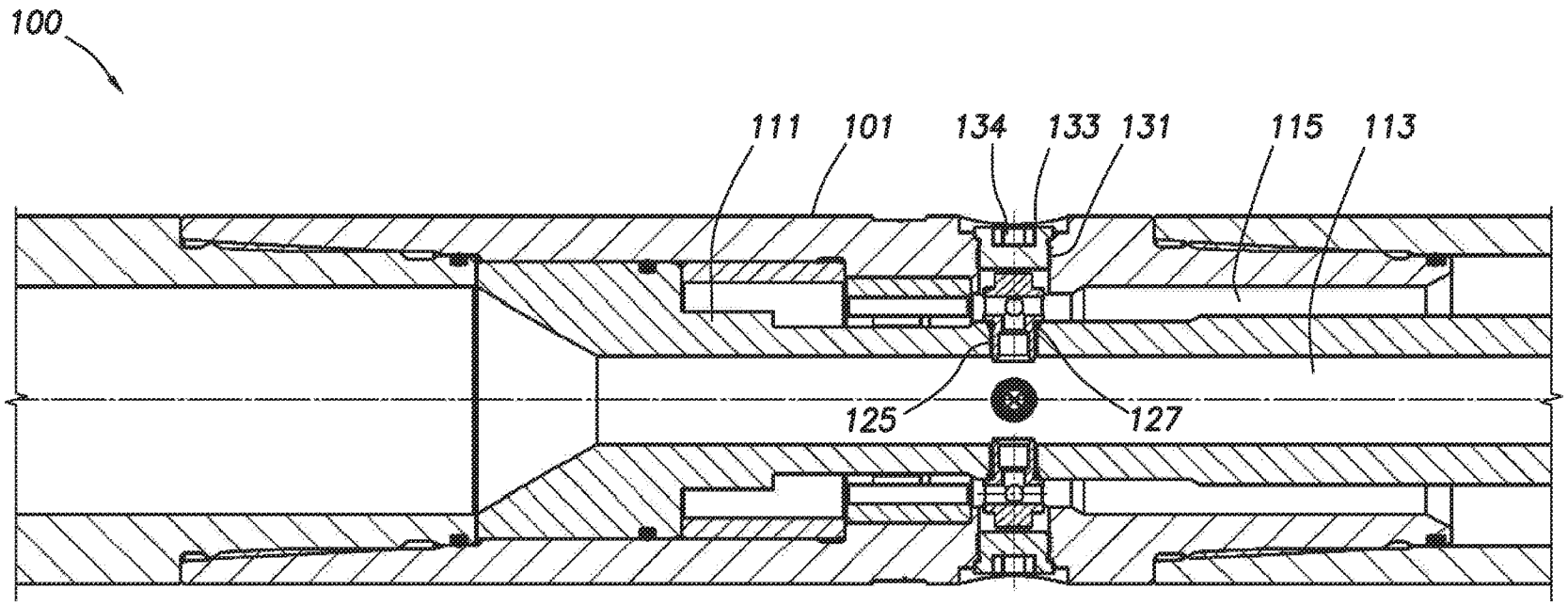
FIGS. 8A-8E depict a nozzle change operation consistent with at least one embodiment of the present disclosure.
Figure 8B:
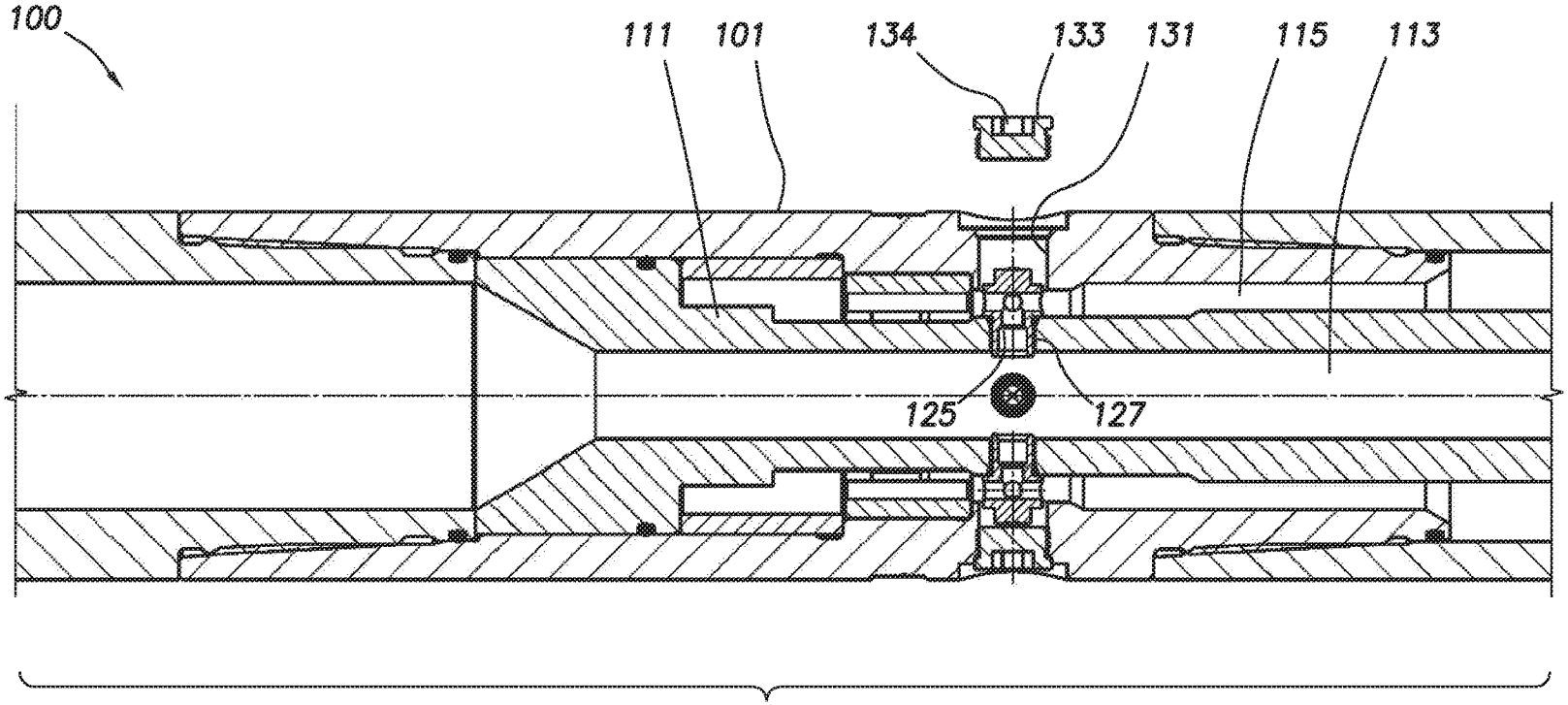

As depicted in FIG. 8A, downhole tool 100 is initially configured with nozzle 127 positioned in nozzle port 125 of mandrel 111. Outer plug 133 is positioned within outer sub port 131 of outer sub 101. To replace nozzle 127, outer plug 133 is first removed from outer sub 101 as depicted in FIG. 8B. Outer plug 133 may be removed, for example and without limitation, by rotating outer plug 133 relative to outer sub 101 using plug drive adapter 134 and a corresponding tool from the outside of downhole tool 100. Once outer plug 133 is removed, nozzle 127 aligned with now-opened outer sub port 131 may be accessed.

Figure 8C:
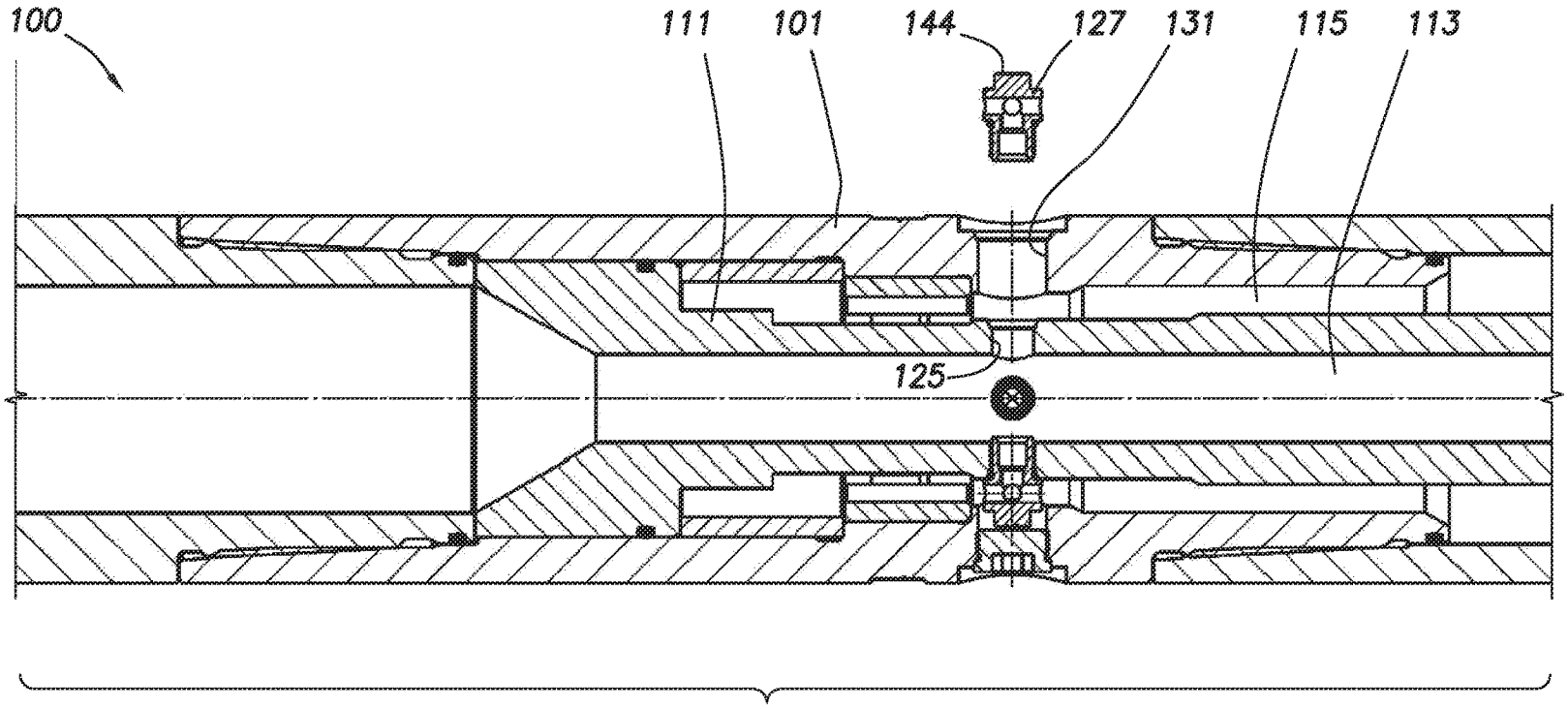

Nozzle 127 may then be removed from nozzle port 125 of mandrel 111 and removed from downhole tool 100 through outer sub port 131 aligned therewith as depicted in FIG. 8C. Nozzle 127 may be removed, for example and without limitation, by rotating nozzle 127 relative to mandrel 111 using nozzle drive adapter 144 and a corresponding tool from the outside of downhole tool 100.

Figure 8D:
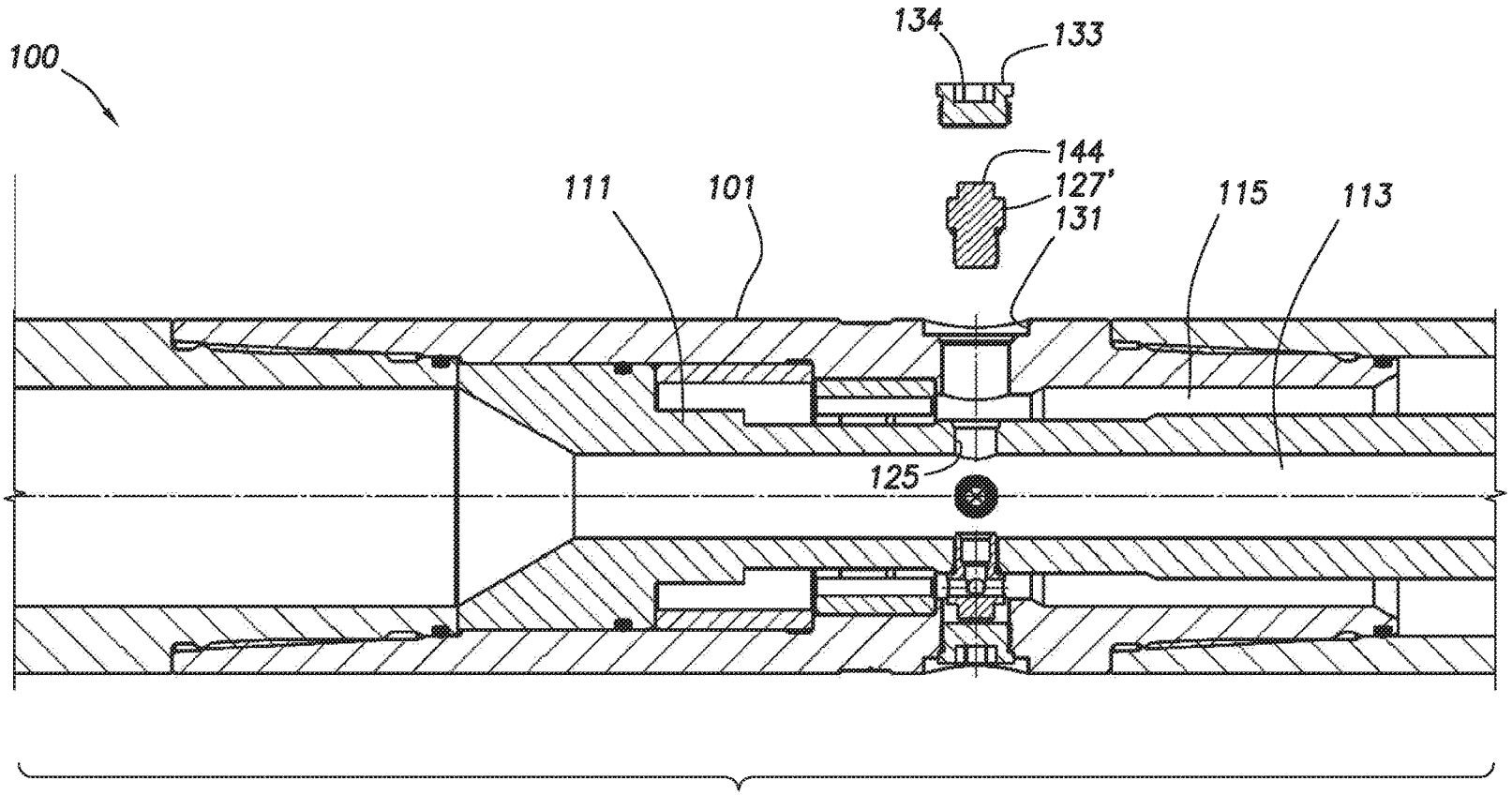
Figure 8E:
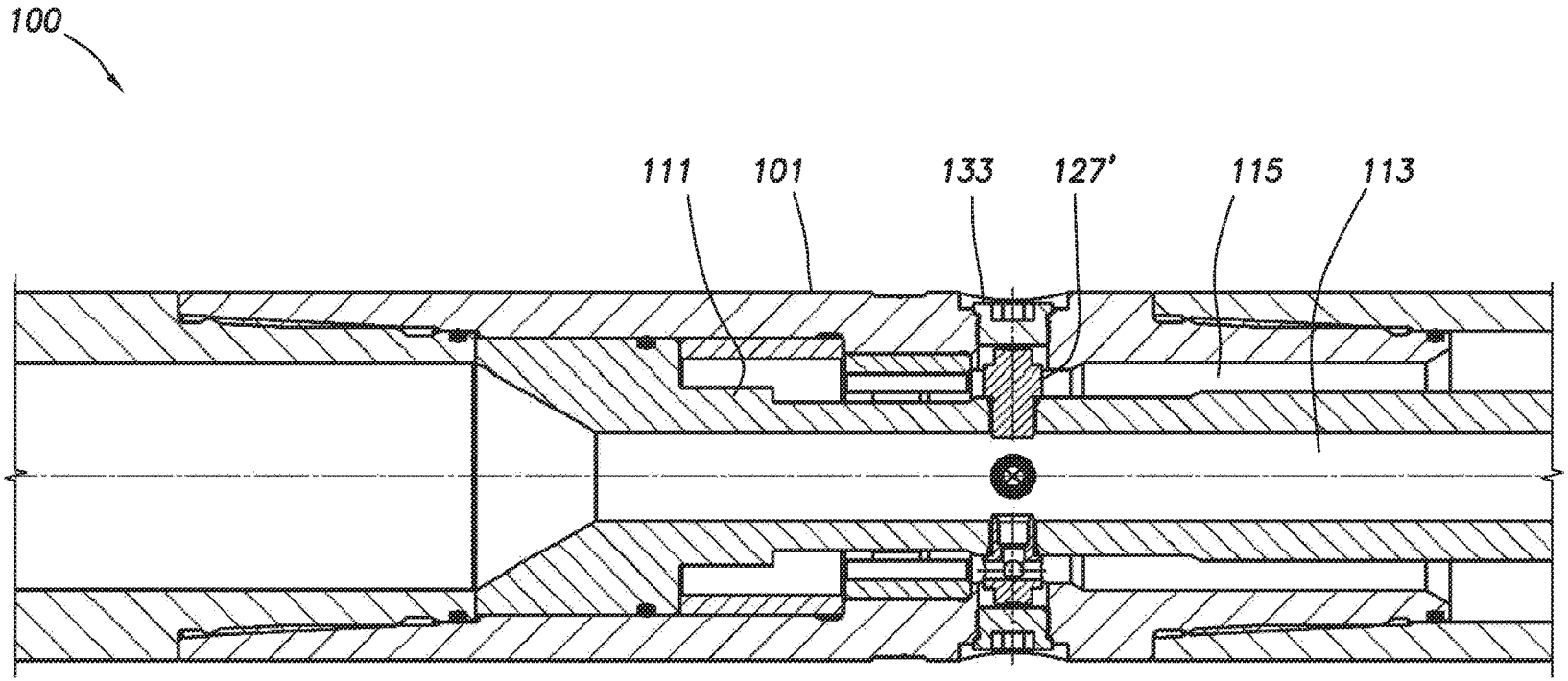

A replacement for nozzle 127 may then be selected. Here, the replacement of nozzle 127 with blank nozzle 127' as depicted in FIG. 8D is depicted. Blank nozzle 127' may be inserted through outer sub port 131 and coupled to nozzle port 125 of mandrel 111. Outer plug 133 may then be reinstalled to outer sub port 131, completing the nozzle replacement operation as depicted in FIG. 8E. If desired, these operations may be repeated to replace one or more of the remaining nozzles 127.

The replacement of nozzles 127 with nozzles having different cross-sectional flow areas or with blank nozzles may therefore change the TFA of annular flow path 115 of downhole tool 100. As an example, where downhole tool 100 includes four nozzles 127, each having a flow path diameter of 12/32", the TFA of annular flow path 115 is 0.440 $in^2$. By replacing one of nozzles 127 with blank nozzle 127' as discussed above, the TFA of annular flow path 115 would be 0.330 $in^2$. Alternatively, replacement of one or more of nozzles 127 with a nozzle having a different flow area may allow granular selection of TFA of annular flow path 115. For example, replacing one of nozzles 127 with a nozzle having a flow path diameter of 8/32" would change the TFA to 0.379 $in^2$. One of ordinary skill in the art with the benefit of this disclosure would understand that any number of nozzles 127 may be replaced with any nozzle having any flow path diameter to allow a user to configure the TFA of annular flow path 115 as desired. Likewise, although a downhole tool 100 having four nozzles 127 is described herein, downhole tool 100 may be configured with any number of nozzles 127.

In some embodiments, downhole tool 100 may be configured such that flow through annular flow path 115 is selectable by downhole tool control apparatus 30 between an unrestricted flow and a flow restricted by one or more nozzles 127 as described herein above. FIGS. 9A and 9B and FIGS. 10A and 10B depict two such embodiments.

Figure 9A:
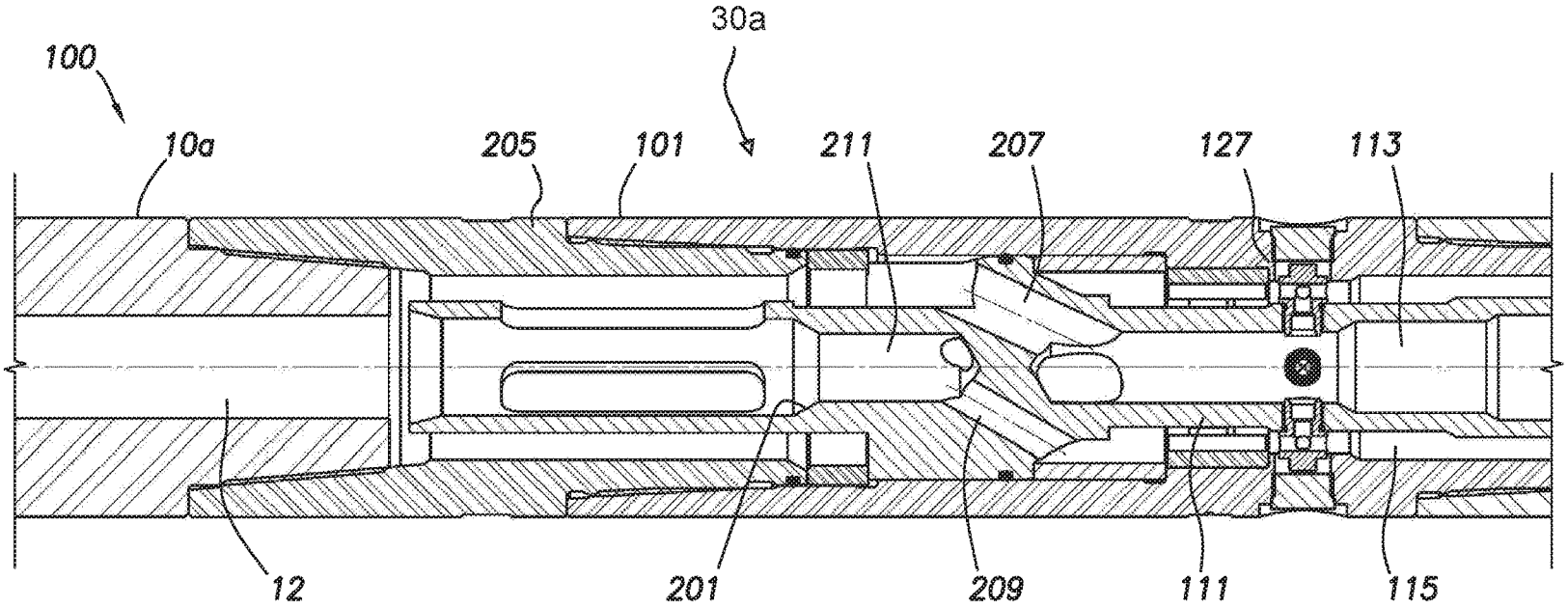
FIGS. 9A and 9B depict cross section views of a downhole tool consistent with at least one embodiment of the present disclosure.
Figure 9B:
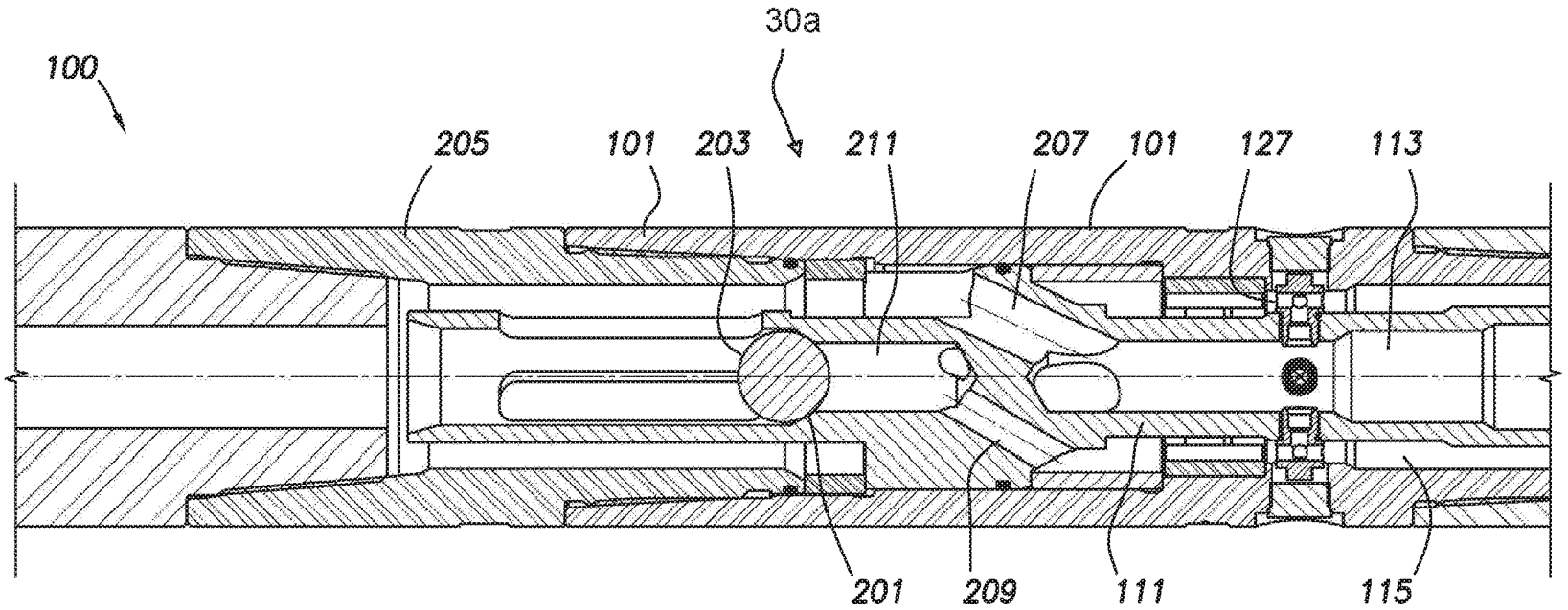

FIGS. 9A and 9B depict embodiments of the present disclosure in which a drop-ball is used to change from unrestricted flow through annular flow path 115 to restricted flow. In some such embodiments, downhole tool control apparatus 30*a* may include ball seat 201 positioned to receive a drop-ball 203. Downhole tool control apparatus 30*a* may include outer collar 205 positioned between outer sub 101 and tubular member 10*a* of drill string 10. Downhole tool control apparatus 30*a* may include bore flow path port 207 extending from an annular space about ball seat 201 to bore flow path 113 and may include annular flow path port 209 extending from blind bore 211 formed behind ball seat 201 and annular flow path 115.

In such a configuration, where no drop-ball is positioned in ball seat 201 as depicted in FIG. 9A, fluid flowing through downhole tool control apparatus 30*a* may flow through both bore flow path port 207 and annular flow path port 209 into bore flow path 113 and annular flow path 115 respectively without restriction. Although nozzles 127 are still included with downhole tool 100, fluid flow through nozzles 127 may not affect the operation of downhole tool 100 due to the unrestricted flow into annular flow path 115 through downhole tool control apparatus 30*a*.

In some embodiments, as depicted in FIG. 9B, once drop-ball 203 is positioned in ball seat 201, annular flow path port 209 is blocked by drop-ball 203 while bore flow path port 207 continues to allow fluid to flow into bore flow path 113. In such a configuration, fluid may flow from bore flow path 113 to annular flow path 115 through nozzles 127 as described herein above.

Figure 10A:
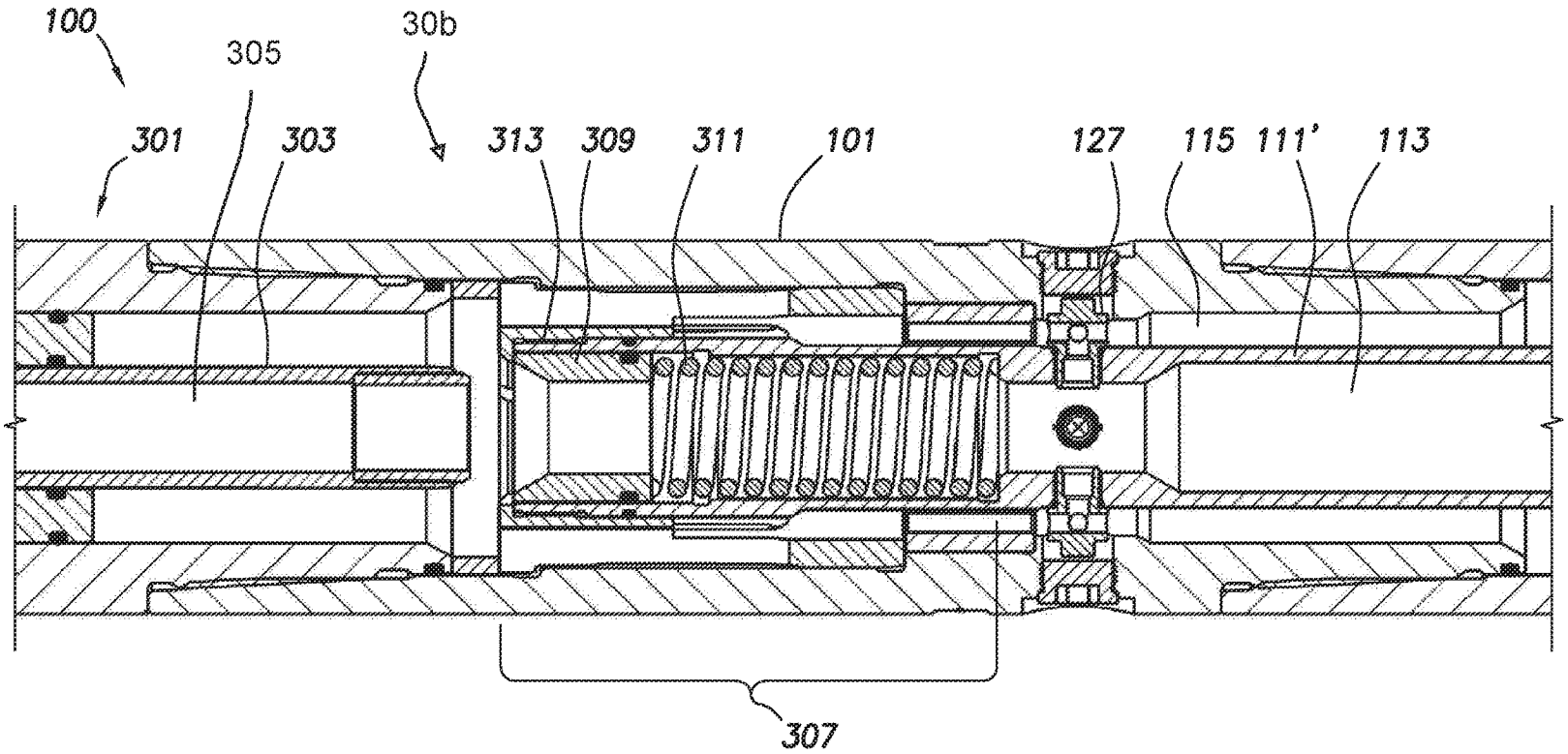
FIGS. 10A and 10B depict cross section views of a downhole tool consistent with at least one embodiment of the present disclosure.
Figure 10B:
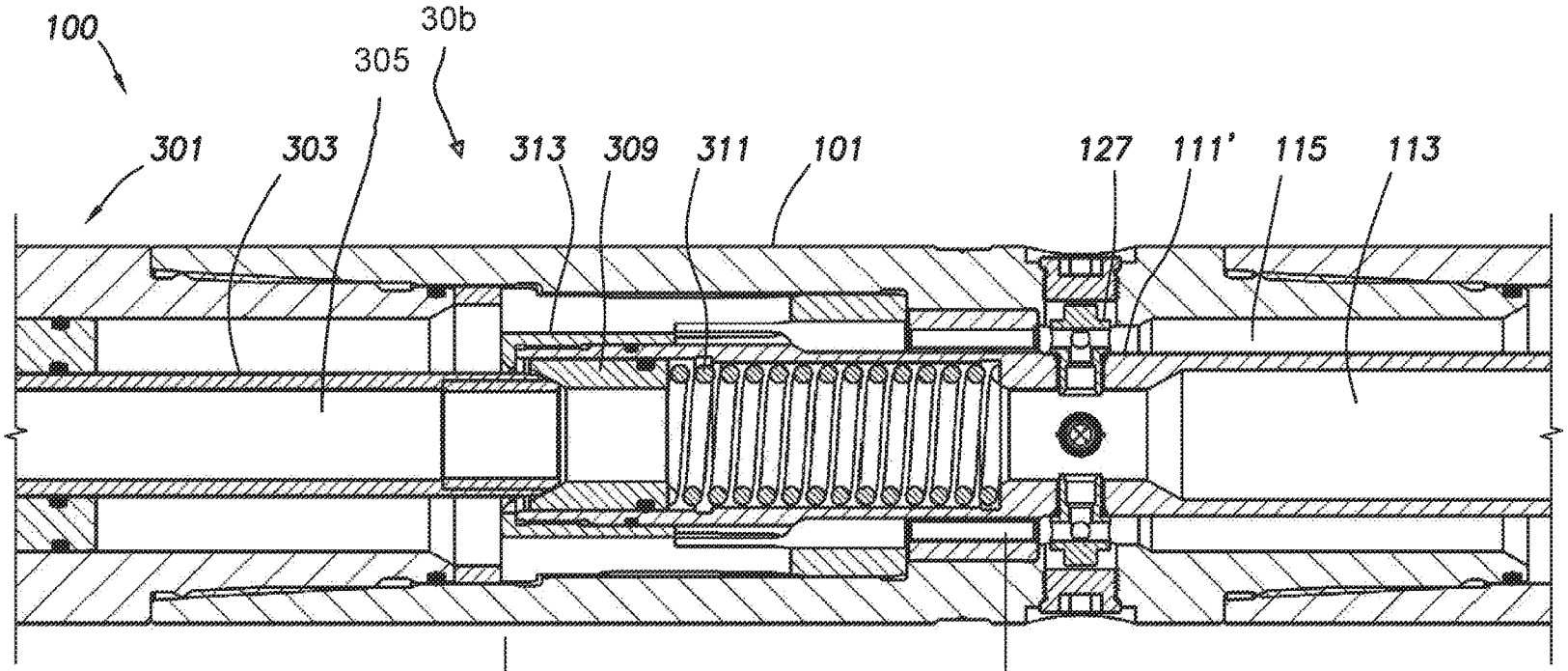

FIGS. 10A and 10B depict embodiments of the present disclosure in which downhole tool control apparatus 30*b* includes an indexer 301 having indexer mandrel 303 used to change from unrestricted flow through annular flow path 115 to restricted flow. Indexer 301 may be adapted to move indexer mandrel 303 between a retracted position as depicted in FIG. 10A and an extended position as depicted in FIG. 10B.

In some embodiments, when indexer mandrel 303 is positioned in the retracted position as depicted in FIG. 10A, fluid flow through indexer bore 305 of indexer mandrel 303 may flow through bore flow path 113 and annular flow path 115 as, in such an embodiment, mandrel 111' is not sealed against outer sub 101. Although nozzles 127 are still included with downhole tool 100, fluid flow through nozzles 127 may not affect the operation of downhole tool 100 due to the unrestricted flow into annular flow path 115 through downhole tool control apparatus 30*b*.

In some embodiments, when indexer mandrel 303 is positioned in the extended position as depicted in FIG. 10B, indexer mandrel 303 may engage with mandrel extension assembly 307 and may fluidly seal thereagainst such that indexer bore 305 is fluidly sealed to bore flow path 113. In some embodiments, mandrel extension assembly 307 may include one or more components adapted to allow seating between indexer mandrel 303 and mandrel 111', and may include, for example and without limitation, follower 309 and spring 311. In some embodiments, mandrel extension assembly 307 may further include endcap 313 positioned to retain follower 309 against the force of spring 311.

Once indexer mandrel 303 is extended and engages mandrel extension assembly 307, annular flow path 115 is no longer fluidly coupled to indexer bore 305 at indexer mandrel 303 while the connection between indexer mandrel 303 and mandrel extension assembly 307 allows fluid to flow into bore flow path 113. In such a configuration, fluid may flow from bore flow path 113 to annular flow path 115 through nozzles 127 as described herein above.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole tool comprising:

an outer sub, the outer sub being tubular;

a mandrel, the mandrel being tubular and positioned within the outer sub, the interior of the mandrel defining a bore flow path, an annular space between the mandrel and the outer sub defining at least part of an annular flow path, the mandrel having at least one nozzle port formed in the mandrel fluidly coupling the bore flow path to the annular flow path;

a nozzle, the nozzle mechanically coupled to the nozzle port of the mandrel, the nozzle including a nozzle body, the nozzle body having a flow path formed therein to fluidly couple the bore flow path to the annular flow path through the nozzle; and a fluid-actuated device, the fluid-actuated device coupled to at least one of the bore flow path and the annular flow path, the fluid-actuated device having one or more operational states or one or more parameters, the one or more operational states or one or more parameters changed by fluid flow through the bore flow path and annular flow path, wherein the fluid-actuated device includes a fluid-actuated or fluid-controlled reamer, underreamer, packer, downhole motor, stabilizer, centralizer, pulse tool, vibration tool, or jarring tool.

2. The downhole tool of claim 1, wherein the outer sub has an outer sub port formed therein, the outer sub port extending through the wall of the outer sub, the outer sub port aligned with the nozzle flow port, and wherein the downhole tool further comprises an outer plug mechanically coupled to the outer sub port, the outer plug being removeable and fluidly sealing the outer sub port.

3. The downhole tool of claim 1, wherein the nozzle body comprises a nozzle shank and a nozzle head, the nozzle shank including a coupler for mechanically coupling to the nozzle port, and wherein the flow path of the nozzle passes through the nozzle shank, defining a nozzle entry port.

4. The downhole tool of claim 3, wherein the nozzle head has a larger diameter than the nozzle shank, and wherein the nozzle flow path passes through the nozzle head defining a nozzle exit port.

5. The downhole tool of claim 4, comprising a second nozzle exit port, the first and second nozzle exit ports formed in a cruciform pattern.

6. The downhole tool of claim 3, wherein the coupler of the nozzle shank is a threaded connector.

7. The downhole tool of claim 6, wherein the nozzle body further comprises a nozzle drive adapter positioned on the nozzle head opposite the nozzle shank, the nozzle drive adapter including one or more slots, polygonal bosses, or shaped recesses adapted to couple to a corresponding tool to remove or install the nozzle.

8. The downhole tool of claim 1, further comprising a ball seat, the ball seat adapted to receive a drop ball such that when the drop ball is positioned in the ball seat, the annular flow path is fluidly coupled to the bore flow path through the nozzle flow path alone.

9. The downhole tool of claim 1, wherein the outer sub further comprises an upper coupler and a lower coupler, the upper and lower couplers adapted to allow the outer sub to couple to a drill string.

10. A downhole tool comprising:

an outer sub, the outer sub being tubular;

a mandrel, the mandrel being tubular and positioned within the outer sub, the interior of the mandrel defining a bore flow path, an annular space between the mandrel and the outer sub defining at least part of an annular flow path, the mandrel having at least one nozzle port formed in the mandrel fluidly coupling the bore flow path to the annular flow path, the mandrel including an alignment spline and the outer sub including an alignment slot, the alignment spline adapted to engage the alignment slot such that the nozzle port and the outer sub port are angularly aligned;

a nozzle, the nozzle mechanically coupled to the nozzle port of the mandrel, the nozzle including a nozzle body, the nozzle body having a flow path formed therein to fluidly couple the bore flow path to the annular flow path through the nozzle; and a fluid-actuated device, the fluid-actuated device coupled to at least one of the bore flow path and the annular flow path, the fluid-actuated device having one or more operational states or one or more parameters, the one or more operational states or one or more parameters changed by fluid flow through the bore flow path and annular flow path.

11. A downhole tool comprising:

an outer sub, the outer sub being tubular;

a mandrel, the mandrel being tubular and positioned within the outer sub, the interior of the mandrel defining a bore flow path, an annular space between the mandrel and the outer sub defining at least part of an annular flow path, the mandrel having at least one nozzle port formed in the mandrel fluidly coupling the bore flow path to the annular flow path, the mandrel including a flange, the flange positioned at an upper end of the mandrel, the flange having a larger diameter than the rest of the mandrel such that the diameter of the flange corresponds with the inner diameter of the outer sub such that the mandrel is fluidly sealed to the outer sub at the flange;

a nozzle, the nozzle mechanically coupled to the nozzle port of the mandrel, the nozzle including a nozzle body, the nozzle body having a flow path formed therein to fluidly couple the bore flow path to the annular flow path through the nozzle; and a fluid-actuated device, the fluid-actuated device coupled to at least one of the bore flow path and the annular flow path, the fluid-actuated device having one or more operational states or one or more parameters, the one or more operational states or one or more parameters changed by fluid flow through the bore flow path and annular flow path.

12. The downhole tool of claim 11, wherein the outer sub further comprises a mandrel hanger, the mandrel hanger being a lip or ridge formed on the inner surface of the outer sub such that the flange of the mandrel rests on the mandrel hanger.

13. A downhole tool comprising:

an outer sub, the outer sub being tubular;

a mandrel, the mandrel being tubular and positioned within the outer sub, the interior of the mandrel defining a bore flow path, an annular space between the mandrel and the outer sub defining at least part of an annular flow path, the mandrel having at least one nozzle port formed in the mandrel fluidly coupling the bore flow path to the annular flow path;

a nozzle, the nozzle mechanically coupled to the nozzle port of the mandrel, the nozzle including a nozzle body, the nozzle body having a flow path formed therein to fluidly couple the bore flow path to the annular flow path through the nozzle;

a fluid-actuated device, the fluid-actuated device coupled to at least one of the bore flow path and the annular flow path, the fluid-actuated device having one or more operational states or one or more parameters, the one or more operational states or one or more parameters changed by fluid flow through the bore flow path and annular flow path; and an indexer, the indexer including an indexer mandrel, the indexer mandrel positionable between a retracted position and an extended position such that when the indexer mandrel is positioned in the extended position, the annular flow path is fluidly coupled to the bore flow path through the nozzle flow path alone.

14. A downhole apparatus comprising:

a downhole tool, the downhole tool including:

an outer sub, the outer sub being tubular;

a mandrel, the mandrel being tubular and positioned within the outer sub, the interior of the mandrel defining a bore flow path, an annular space between the mandrel and the outer sub defining at least part of an annular flow path, the mandrel having at least one nozzle port formed in the mandrel fluidly coupling the bore flow path to the annular flow path; and a nozzle, the nozzle mechanically coupled to the nozzle port of the mandrel, the nozzle including a nozzle body, the nozzle body having a flow path formed therein to fluidly couple the bore flow path to the annular flow path through the nozzle;

a downhole tool control apparatus, the downhole tool control apparatus adapted to selectively open or close an unrestricted flow path from the bore flow path to the annular flow path, the downhole tool control apparatus including an indexer; and a fluid-actuated device, the fluid-actuated device coupled to at least one of the bore flow path and the annular flow path, the fluid-actuated device having one or more operational states or one or more parameters, the one or more operational states or one or more parameters changed by fluid flow through the bore flow path and annular flow path.

15. The downhole apparatus of claim 14, wherein the downhole tool control apparatus comprises a ball seat.

* * * * *